United States Patent [19]

Artz et al.

[11] Patent Number: 4,553,582

[45] Date of Patent: Nov. 19, 1985

[54] APPARATUS FOR CASTING STEEL IN A CONTINUOUS CASTING MOLD EQUIPPED WITH COMOVING MOLD WALLS

[75] Inventors: Gerd Artz, Ratingen; Dieter Figge, Essen; Thomas Hoster, Essen; Jürgen Pötschke, Essen, all of Fed. Rep. of Germany

[73] Assignee: Fried. Krupp Gesellschaft mit beschränkter Haftung, Essen, Fed. Rep. of Germany

[21] Appl. No.: 661,251

[22] Filed: Oct. 15, 1984

[30] Foreign Application Priority Data

Oct. 15, 1983 [DE] Fed. Rep. of Germany ..... 3337583

[51] Int. Cl.[4] ..... B22D 11/06

[52] U.S. Cl. ..... 164/432; 164/431; 164/439

[58] Field of Search ..... 164/437, 439, 440, 431, 164/432, 488, 490, 481

[56] References Cited

U.S. PATENT DOCUMENTS 3,857,437 12/1974 Watts ..... 164/490 X
4,456,054 6/1984 Henders ..... 164/440 X

FOREIGN PATENT DOCUMENTS 56-154265 11/1981 Japan ..... 164/440
57-88952 6/1982 Japan ..... 164/440

*Primary Examiner*—Nicholas P. Godici
*Assistant Examiner*—Kenneth F. Berg
*Attorney, Agent, or Firm*—Spencer & Frank

[57] ABSTRACT

To produce steel sheet cross sections, particularly those having a small thickness down to a lower limit of about 30 mm and a width of about 500 to 1500 mm, with high surface quality and at a high casting rate (about 10 m/min) at relatively low expense in continuous casting molds equipped with comoving mold walls defining a casting cross section or cavity, a tubular casting nozzle having a mouthpiece whose width at its exit cross section is less than 50% of the width of the casting cavity is utilized, and the space between the sidewalls of the mouthpiece and the adjacent lateral dams or sidewalls of the casting cavity is bridged by means of two symmetrically oriented rotating wheels provided with ceramic rims. The wheels are of a size such that they simultaneously form a seal together with the mouthpiece and the respective, oppositely disposed lateral dams and casting belts defining the casting cavity.

20 Claims, 8 Drawing Figures

APPARATUS FOR CASTING STEEL IN A CONTINUOUS CASTING MOLD EQUIPPED WITH COMOVING MOLD WALLS

BACKGROUND OF THE INVENTION

The present invention relates to an apparatus for casting steel sheets, particularly those having thin cast cross sections with a thickness down to a lower limit of about 30 mm and a width of about 500 to 1500 mm, in a continuous casting mold equipped with comoving mold walls which are composed of pairs of oppositely disposed endless casting belts and endless lateral dams and define a casting cavity into which the mouthpiece of a tubular casting nozzle extends.

Continuous casters equipped with comoving mold walls (i.e. moving in the casting direction) are presently being used with success for casting lead, zinc and copper at high casting rates around 10 m/min, with the metal melt being introduced into the casting cavity through a trough.

The two lateral dams serving as lateral limitations pass along the continuous casting mold in an essentially straight line; that is, their mutual spacing decreases only slightly in the casting direction for compensation of the shrinkage as a result of solidification of the cast sheet.

The casting of steel of a sufficiently good metallurgical quality requires continuous casters equipped with comoving mold walls in which the entrance of air is avoided in that they are equipped with tubular, i.e. closed, casting nozzles. Such nozzles additionally permit casting under pressure, thus eliminating undesirable fluctuations in the casting level within the casting mold and permitting uniform, symmetrical cooling of the cast product. To be able to roll this cast product under economical conditions, it is necessary to have available material which, with a width of 500 to 1500 mm thickness does not, as previously, have a thickness of 150 to 250 mm, but rather has a thickness which lies only in the order of magnitude of from 30 to 50 mm.

The correct introduction of steel in view of the seal required between parts that move relative to one another (casting nozzle, mold walls), while at the same time avoiding freezing and undesirable solidification in the region of the mouthpiece of the casting nozzle, is very difficult to realize with a billet-type cross section (for example, those having a width of 180 mm) and necessitates the maintenance of the most uniform possible, tight seal between the nozzle mouthpiece and the moving mold walls. Casting of sheet cross sections, for example, those having a width between 500 and 1500 mm, is possible only at added expense because of the correspondingly enlarged dimensions of the casting nozzle which correspond approximately to those of the cast product. Moreover, the enlarged dimensions involve an increased danger of deformation of the casting nozzle and higher material costs for the casting nozzle which consists, for example, at least partly of boron nitride.

SUMMARY OF THE INVENTION

It is the object of the present invention to develop an apparatus for casting steel sheet which, even with the wide sheet cross section relative to its slight thickness and with respect to realizing a good seal between parts that move relative to one another, is as uncomplicated as possible.

The above object is achieved according to the present invention by an apparatus for the continuous casting of steel sheet, particularly steel sheet having cross sections of a small thickness down to a lower limit of about 30 mm and a width of about 500 to 1500 mm, comprising a continuous caster having comoving mold walls which define a casting cavity and which include a pair of oppositely disposed endless casting belts which form the upper and lower walls of the casting cavity and a pair of oppositely disposed endless lateral dams which form the lateral walls of the casting cavity, and a tubular casting nozzle having a mouthpiece which extends symmetrically into the casting cavity and contacts the casting belts forming the upper and lower casting cavity walls to form a seal therebetween; and wherein: the width of the mouthpiece of the casting nozzle at its exit cross section is less than approximately 50% of the width of the casting cavity; and the apparatus further comprises means for sealing the space in the casting cavity between each of the lateral dams and the adjacent side wall of the mouthpiece of the nozzle, this means including a pair of wheels each having a ceramic outer rim, and means for mounting each of the wheels for rotation about a respective vertical axis such that the wheels are symmetrically disposed between the mouthpiece and the dams, with each of the wheels having a diameter such that its rim contacts one of the lateral dams and the adjacent side wall of the mouthpiece and a height such that its upper and lower surfaces contact the upper and lower walls respectively of the casting cavity formed by said endless belts, and means for rotating the wheels.

The basic idea of the invention is thus to make the exit width at the exit cross section of the mouthpiece of the casting nozzle, which projects into the casting mold, considerably narrower (i.e. by more than a factor of 2) than the mutual spacing between the lateral dams, which define the width of the cast sheet, and to establish a sufficiently tight seal between the moving parts forming the casting mold and the nozzle mouthpiece. In order to be able to produce the required seal between the mouthpiece and the mold walls, the space between these parts which move relative to one another is bridged by two rotating wheels which may be formed entirely of ceramic material but which are each equipped with at least a ceramic rim. Each of these wheels simultaneously forms a seal with the mouthpiece and with the lateral dam opposite thereto as well as with the casting belts.

With the basic idea of the present invention, the exit cross section of the mouthpiece thus becomes wider over sections of successive circumferential faces of the ceramic wheels in the casting direction until it reaches the spacing between the lateral dams which define the width of the casting cavity. Advisably the ceramic wheels are driven in such a manner that, on the side of each wheel facing or adjacent the mouthpiece, the wheels rotate in the direction opposite to the casting direction. This has the result that the direction of movement of the ceramic wheels in the vicinity of the lateral dams is the same as the direction of movement of the lateral dams in the casting direction. In the transition region between the ceramic wheels and the lateral dams, the steel melt is thus transported away in the casting direction.

According to a feature of the invention, in order to prevent the steel melt from sticking to the ceramic surface or rim of the wheels, each wheel is equipped, in the region of its outer section facing away from the casting cavity, i.e., in the rear region between the mouthpiece and the lateral dams, with a coating unit able to coat at least the ceramic circumferential surfaces of the wheels with a coating agent. Such an agent may contain graphite, in particular, or may consist of a boron nitride emulsion.

To avoid the onset of solidification, according to a further feature of the invention, the wheels are preferably equipped with heating units by means of which at least the circumferential ceramic surfaces of the wheels are preheated to a temperature between 900° and 1300° C., preferably to 1100° C. In a preferred embodiment of the invention, the heating units are stationarily arranged in the spaces between the ceramic rim and the hub of the respective wheels and preferably face the casting cavity, so that the heating effort is particularly intensive in that region of the wheels which comes into contact with the steel melt. However, the apparatus according to the present invention may also be equipped in such a manner that the heating units face the ceramic rims of the wheels in the region of their outer section facing away from the casting cavity. In this latter case, the ceramic rims of the wheels are thus heated externally.

Advisably each wheel is also equipped with a drive which is disposed in the region of its outer section facing away from the casting cavity. This drive is comprised, according to a further feature of the invention, of a drive roller which is driven by a compressed-air motor and is urged into resilient contact with the circumferential ceramic surface of the associated wheel. The advantage of the use of rotating wheels is also that the wheels can be driven, coated and heated after passing through the casting cavity, i.e. on their way back to the front of the continuous casting mold, when seen in the casting direction.

The embodiment in which the heating units are arranged in the space between the ceramic rim and the hub of the respective wheels can be modified in an advantageous manner in that the heating units, which are provided in the form of inductors, are simultaneously designed to provide electromagnetic barriers which prevent the escape of steel melt past the wheels in a direction opposite to the casting direction. In this case, the heating units thus perform a dual function: the heating units required in any case to preheat the ceramic rims of the wheels also generate electromagnetic forces which make impossible the passage of steel melt through the seals between the mouthpiece and the ceramic wheels and between the ceramic wheels and the lateral dams, respectively. Preferably, the dual action heating units under discussion are designed and arranged in such a manner that their effectiveness extends particularly along the region of the two seals.

Preferably, in order to provide a particularly effective seal between the mouthpiece and the ceramic rims of the wheels, the lateral side walls of the mouthpiece are concavely curved from a point upstream of the exit cross-section of the mouthpiece, where the width of the mouthpiece is greater than that at the exit cross-section, to the exit cross-section. Each curved surface preferably forms a segment of a circle which coacts with the contacting peripheral surface of the associated wheel.

To provide an improved seal between the mouthpiece and the wheels, (i.e. between the curved outer side surfaces of the mouthpiece which coact with the ceramic rims of the wheel) the mouthpiece, which is mounted so as to be movable in the casting direction, preferably is resiliently supported by the rotating wheels in the vicinity of its exit cross section. An improved seal between the ceramic rim of the wheels and the lateral dams preferably is realized in that the latter are resiliently urged against and held in contact with the ceramic rims of the wheels by means of a respective pressure unit.

In the embodiments of the invention in which the lateral dams are assembled of individual members or block in the manner of a chain, the already mentioned drive rollers for driving the wheels are used in the normal case. However, the lateral dams may also be comprised of endless multi-layer steel belts which are mounted, when seen in the casting direction, about guide rollers disposed upstream of the wheels and are held in contact with the peripheral surface of the ceramic rims of the wheels. In these embodiments, where the lateral dams are able to negotiate curves in the horizontal plane, a special drive unit for the wheels may be omitted. The wheels are then also driven by the endless multi-layer steel belts.

In the embodiments of the present invention in which inductors are provided in the wheels and the lateral dams are comprised of endless multi-layer steel belts, the seal between the ceramic rims of the wheels and the multi-layer steel belts may advantageously be realized in that the exterior of the multi-layer steel belts face additional inductors each cooperating with the inductor disposed in the associated wheel. In this case, an electric barrier is formed, not only by the inductors of the respective wheel which face one another with respect to the casting nozzle, but also by the inductors of the wheels and additional inductors which face one another with respect to the multi-layer steel belts, thus preventing the escape to the outside of steel melt in the direction opposite the casting direction.

Advisably, the lateral dams are guided in a straight line over the entire length of the casting cavity and are at least approximately parallel to one another. Consequently, lateral dams can also be used which are combined of individual sections that are not designed to go through curves in the horizontal direction.

The use of wheels having at least ceramic rims to bridge the space between the mouthpiece and the lateral dams permits not only the use of mouthpieces having small dimensions, but additionally permits the continuous casting mold to be adapted to different sheet cross sections by the installation of different configurations, and particularly different sizes, of wheels.

The present invention will now be described in detail with the aid of several embodiments that are illustrated in the drawings.

DETAILED DESCRIPTION OF THE PREFERRED EMBODIMENTS

Figure 1:
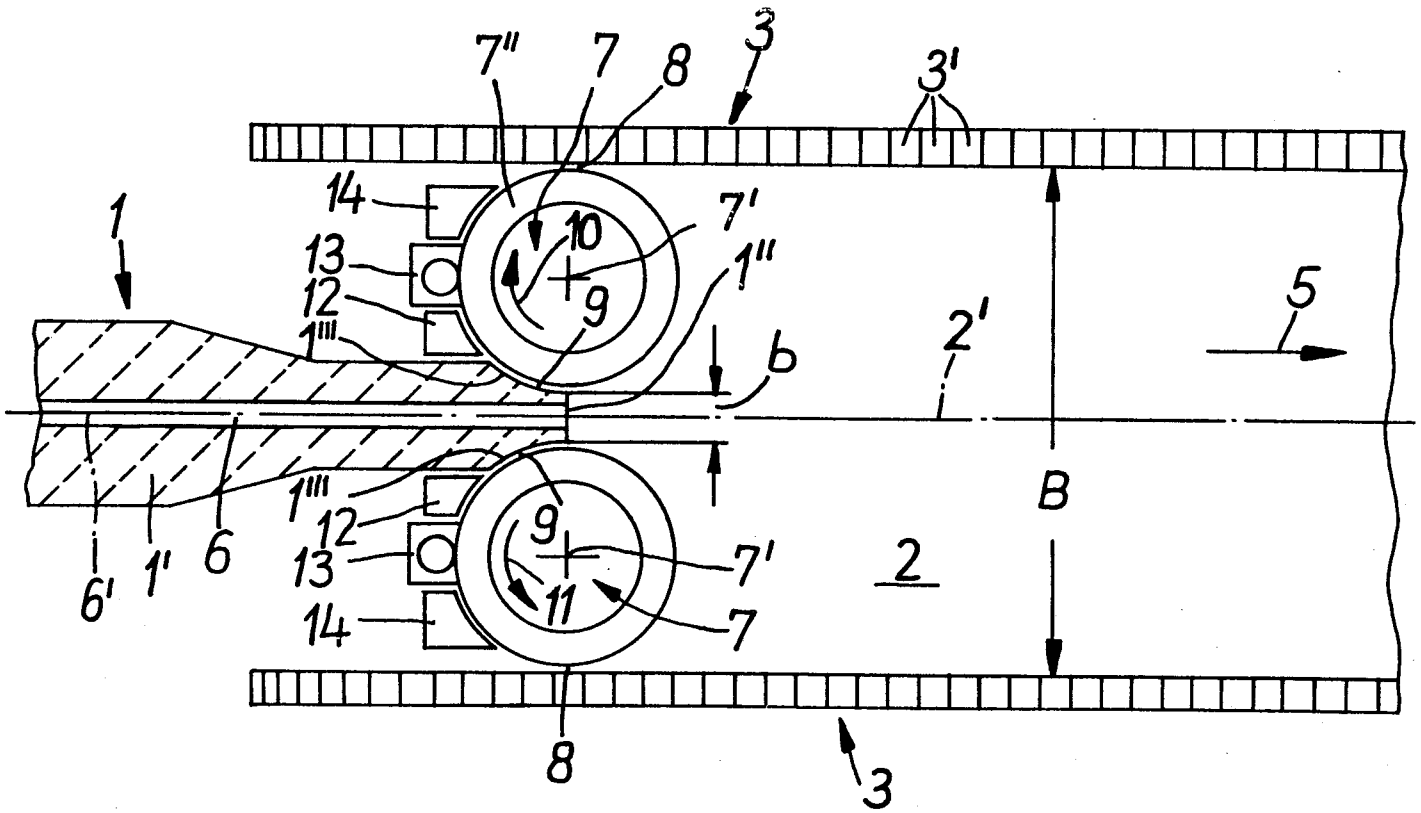
FIG. 1 is a highly schematic horizontal partial sectional view of an apparatus according to the present invention for the casting of steel sheet, the apparatus including a casting nozzle and two wheels which bridge the space between the nozzle and the lateral dams of the casting cavity.

In the apparatus according to the present invention, the steel melt to be processed comes from a tundish (not shown) through a tubular casting nozzle 1 having a mouthpiece 1' into the casting cavity 2 of a continuous casting mold. In a manner well known in the art, the casting cavity 2 of the continuous casting mold is laterally defined by two lateral dams 3 comprised of individual members 3' forming an endless chain and is defined at the top and bottom by two endless casting belts 4 (shown in FIG. 4). In the region of casting cavity 2, lateral dams 3 and casting belts 4 move at the same speed from the left to the right (see FIG. 1) corresponding to the casting direction indicated by arrow 5. The mouthpiece 1' of the casting nozzle is symmetrically inserted into the casting cavity 2 so that the longitudinal axis 6' of the bore 6 of the casting nozzle 1 coincides with the longitudinal axis 2' of the casting cavity 2.

As shown in FIG. 1, according to the invention, the width b of mouthpiece 1' at its rectangular exit cross section 1'' is less than fifty percent of the width B of the casting cavity 2. In the preferred illustrated embodiment of the invention, the width b of mouthpiece 1' at its exit cross section 1'' is 200 mm and thus a multiple smaller than the distance B between lateral dams 3 of 1200 mm which defines the width of the cast product. This distance B remains unchanged over the length of the casting cavity 2, except at most for a slight reduction to compensate for shrinkage occurring during solidification of the steel melt, i.e., lateral dams 3 are approximately parallel to one another in the region of the casting cavity 2.

Since casting cavity 2 must be sealed from the outside in the direction opposite the casting direction and also in the region of mouthpiece 1', the space between the lateral dams 3 and the outer or lateral side surfaces 1''' of the mouthpiece 1 facing the dams 3 is bridged by two wheels 7 which are rotatably mounted on respective vertical wheel axes 7' which are fixed and lie in the region of the exit cross section 1''. Preferably as shown, the wheel axes 7' and the exit cross section 1'' of the mouthpiece lie in a common vertical plane. The wheels 7 are made, at least in the region of their rims 7'', of a ceramic material resistant to the steel melt, in particular of amorphous silica containing a large amount of alumina, of silica or of zirconium oxide.

Figure 2:
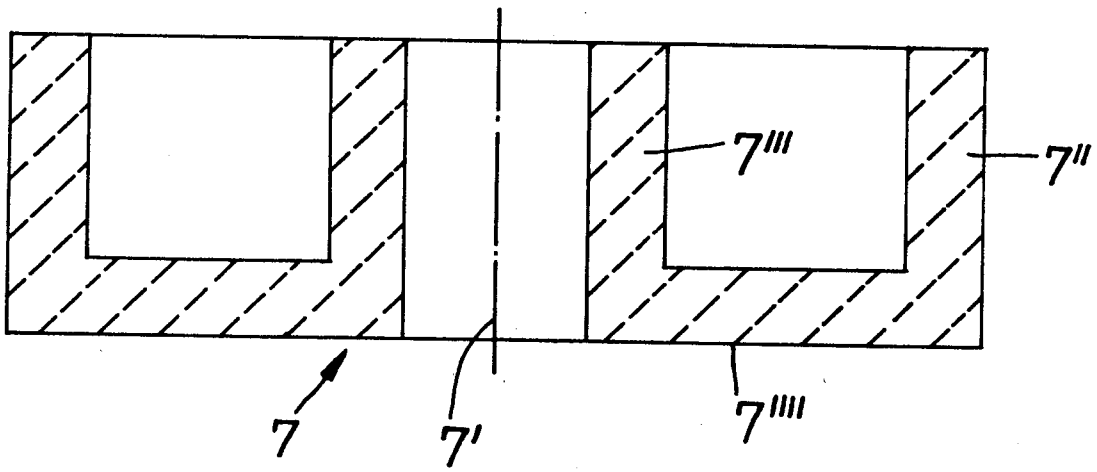
FIG. 2 is a vertical sectional view through a ceramic wheel made in one piece.

As shown in FIG. 2, each wheel 7 includes a vertical outer rim portion 7'' which is joined to a central hub 7''' by a laterally extending member or portion 7''''. As further shown in FIG. 2, each wheel 7 is preferably entirely made of ceramic material and is of one piece construction, i.e. rim portion 7'' directly become hub 7''' which defines the axis 7'' of the wheel. However, for purposes of the present invention, it is only significant that at least the rim portions 7'' are made of a ceramic material, i.e., the portions 7''' and 7'''' following in the direction of wheel axis 7' may possibly also be made of metal.

Preferably, as shown in FIG. 1, the portions 1''' of the outer surfaces of side walls of the mouthpiece 1' which face the wheels 7 are concavely curved so that the width of the mouthpiece 1' narrows in a direction toward the exit cross section 1'' with the curvature of portion 1''' conforming to that of the periphery of rim 7'' of the wheels 7. In this way, a larger area of contact between each of the wheels 7 and a respective side wall of the mouthpiece 1' is provided for sealing purposes.

The mutual association of mouthpiece 1', the two ceramic wheels 7 and lateral dams 3 is selected to be such that the rim 7'' of each ceramic wheel 7 contacts and forms a seal 8 and 9, respectively, with the portion of the lateral dam 3 disposed opposite the mouthpiece and with the correspondingly curved outer surface 1''' of the mouthpiece 1'.

Ceramic wheels 7 rotate in the manner indicated in FIG. 1 by arrows 10 and 11, respectively, i.e. their sense of rotation is opposite to the casting direction (arrow 5) in the vicinity of mouthpiece 1' (i.e., seal 9) and coincides with the direction of movement of lateral dams 3 in the region of seal 8. Thus, ceramic wheel 7 at the top in FIG. 1 rotates clockwise and the ceramic wheel 7 at the bottom in FIG. 1 rotates counterclockwise.

Each ceramic wheel 7 is provided with possibly required additional devices in the region of its outer section facing away from the casting cavity 2 (i.e. at the feed end of the continuous casting mold), and between the respective lateral dam 3 and the mouthpiece 1. When seen in the direction of rotation of the respective ceramic wheel 7, these additional devices are a coating unit 12 with which, for example, a graphite containing coating agent (which prevents sticking of the steel melt to the wheel 7) is applied to at least the circumferential surface of the respective ceramic wheel, a drive unit 13, and a heating unit 14 with which at least the circumferential surface of wheel 7 is preheated to a temperature of about 1100° C. Each ceramic wheel 7 thus has two different effective regions, namely an operating region on the side facing the casting cavity 2 and a servicing region on the opposite, outwardly oriented outer section.

Figure 3:
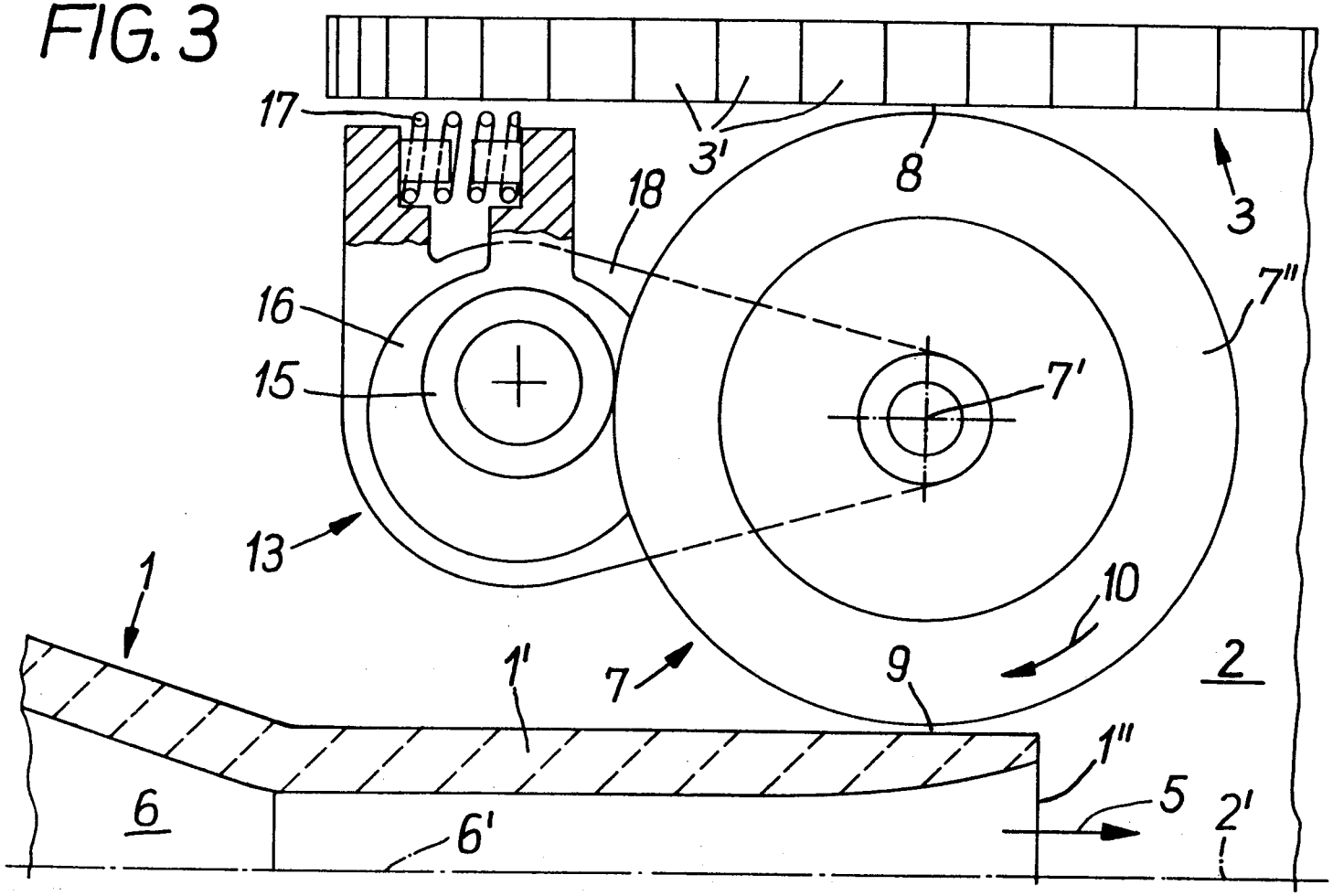
FIG. 3 is a schematic plan view of a ceramic wheel with the drive roller held in contact therewith by means of an eccentric.

As shown in FIG. 3, drive 13, which is disposed on the feed end of the continuous casting mold is essentially comprised of a drive roller 15 which is fastened to an eccentric bushing 16 and is held in contact with the circumferential surface of the ceramic wheel 7 by means of a spring 17 which is supported at the stationary environment or support. The stationary environment or support is here a supporting arm 18 which also supports the axis 7' of the wheel 7.

Figure 4:
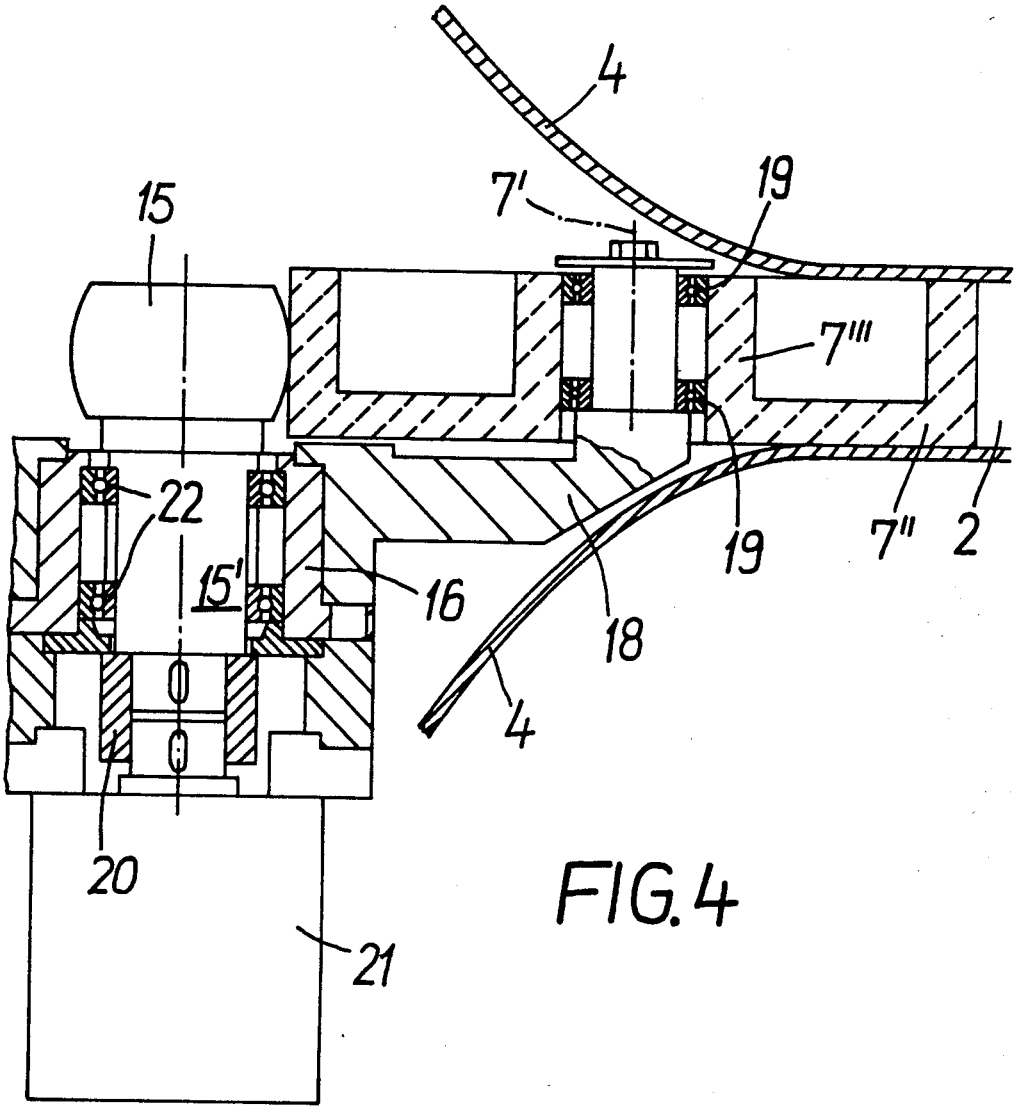
FIG. 4 is a vertical, partially sectional view of the apparatus according to the present invention in the region of one ceramic wheel.

As shown in FIG. 4, the wheel hub 7''' is supported to be rotatable about its wheel axis 7' in a bearings 19 mounted on the arm 18 and shaft 15' of the drive roller 15 is in communication with a compressed air motor 21 disposed therebelow by means of a coupling 20. Shaft 15' is supported in eccentric bushing 16 by means of bearings 22 and forms a pivotal unit with compressed air motor 21 with respect to the supporting arm 18. Preferably, the motors 21 and the drive rollers 15 drive the wheels 7 so that the peripheral speed of the wheels is equal to or slightly greater than the speed of movement of the lateral dams 3.

As further shown in FIG. 4, each ceramic wheel 7 is given a height dimension such that, by way of the upper and lower horizontal surfaces of its rim portion 7'', it forms a seal simultaneously with the respective upper and lower casting belts 4 so that the escape of steel melt from the casting cavity 2 in the direction opposite the casting direction is prevented.

Figure 5:
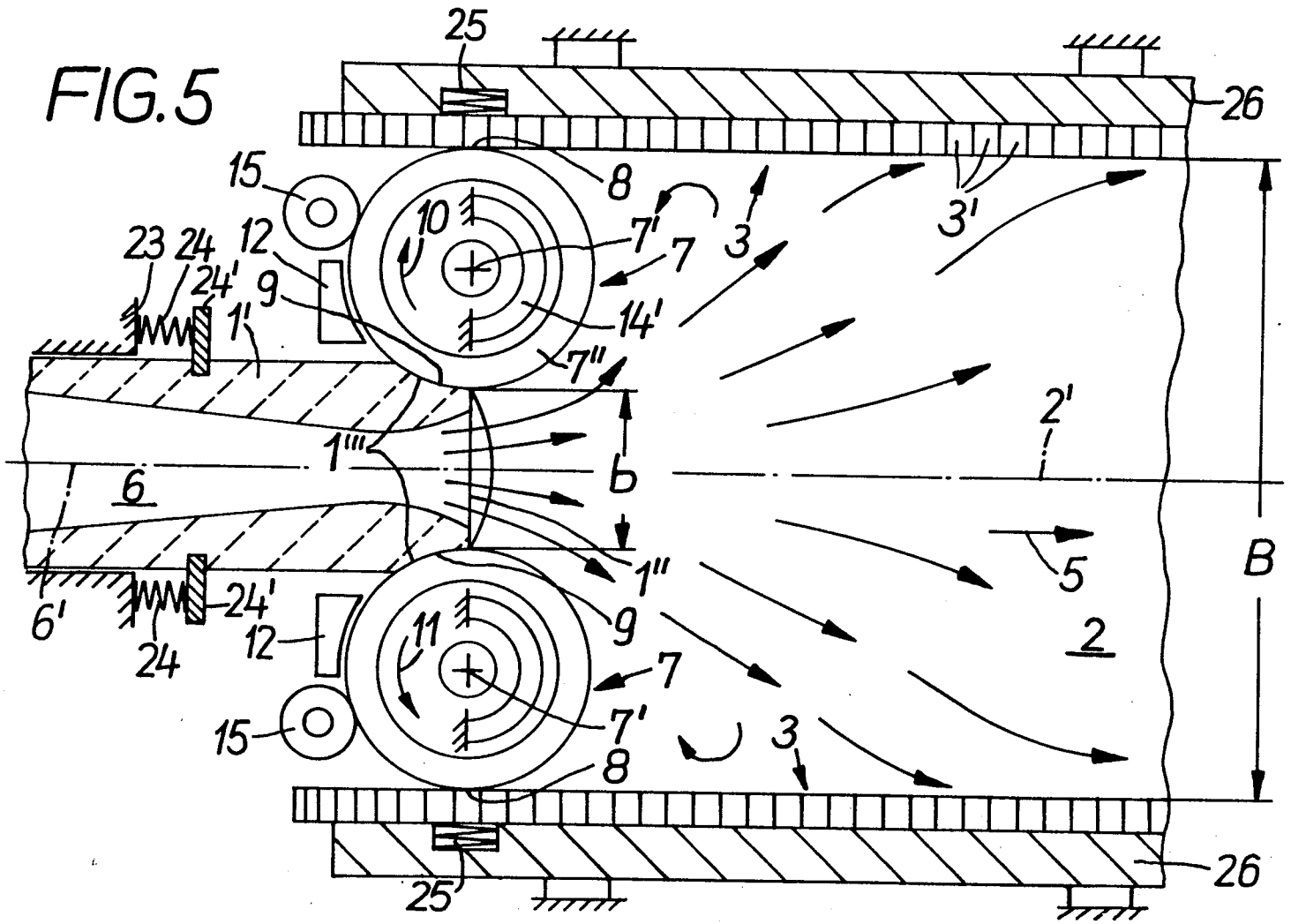
FIG. 5 is a horizontal partially sectional view of the apparatus according to the present invention illustrates heating units disposed in the interior of the ceramic wheels and the resilient support of the casting nozzle.

In the embodiment of the present invention shown in FIG. 5, each of the ceramic wheels 7 is provided, on the feed side of the continuous casting mold, with only a coating unit 12 and a drive in the form of a drive roller 15. In this embodiment, each heating unit 14' is a semicircularly shaped inductance heating element which is stationarily disposed within a respective wheel 7 in the space between the rim 7'' and the hub 7''', and on the side of the wheel 7 facing casting cavity 2. Due to their arrangement and shape, the heating units 14' becomes effective as an electromagnetic barrier to prevent the escape of the steel melt from the casting cavity 2, particularly in that region in which the associated ceramic wheel 7 comes into contact with the steel melt exiting from mouthpiece 1'.

In order to improve the sealing effect between the curved outer surfaces 1''' of mouthpiece 1' and the ceramic wheels 7, as further shown in FIG. 5, the mouthpiece 1' is mounted within a stationary guide 23 so as to be movable in the longitudinal direction, and is provided with compression springs 24 which are disposed between the guide 23 and spring supports 24' fastened to the mouthpiece 1'. The springs 24 thus urge the curved surfaces 1''' into contact with the rims 7'' of ceramic wheels 7, a contact which is resilient in the casting direction.

As further shown in FIG. 5, the sealing effect between the outer or peripheral surfaces of the ceramic wheels and the lateral dams 3 is improved in that the stationary linear guide strips 26 for the lateral dams 3 are provided with respective transverse springs 25 which urge the dams 3 into contact with the wheels 7. The transverse springs 25 are arranged, as shown, in the region defined by the connection line between the two wheel axes 7'.

In order to improve the sealing effect between the mouthpiece 1' and the casting belts 4 (shown in FIG. 4), the upper and lower walls of the mouthpiece 1' are designed to be convex when seen in the casting direction. The respective upper and lower mouthpiece walls thus project farther into the casting cavity 2 of the continuous casting mold than the side walls perpendicular thereto at exit cross section 1''.

Figure 6:
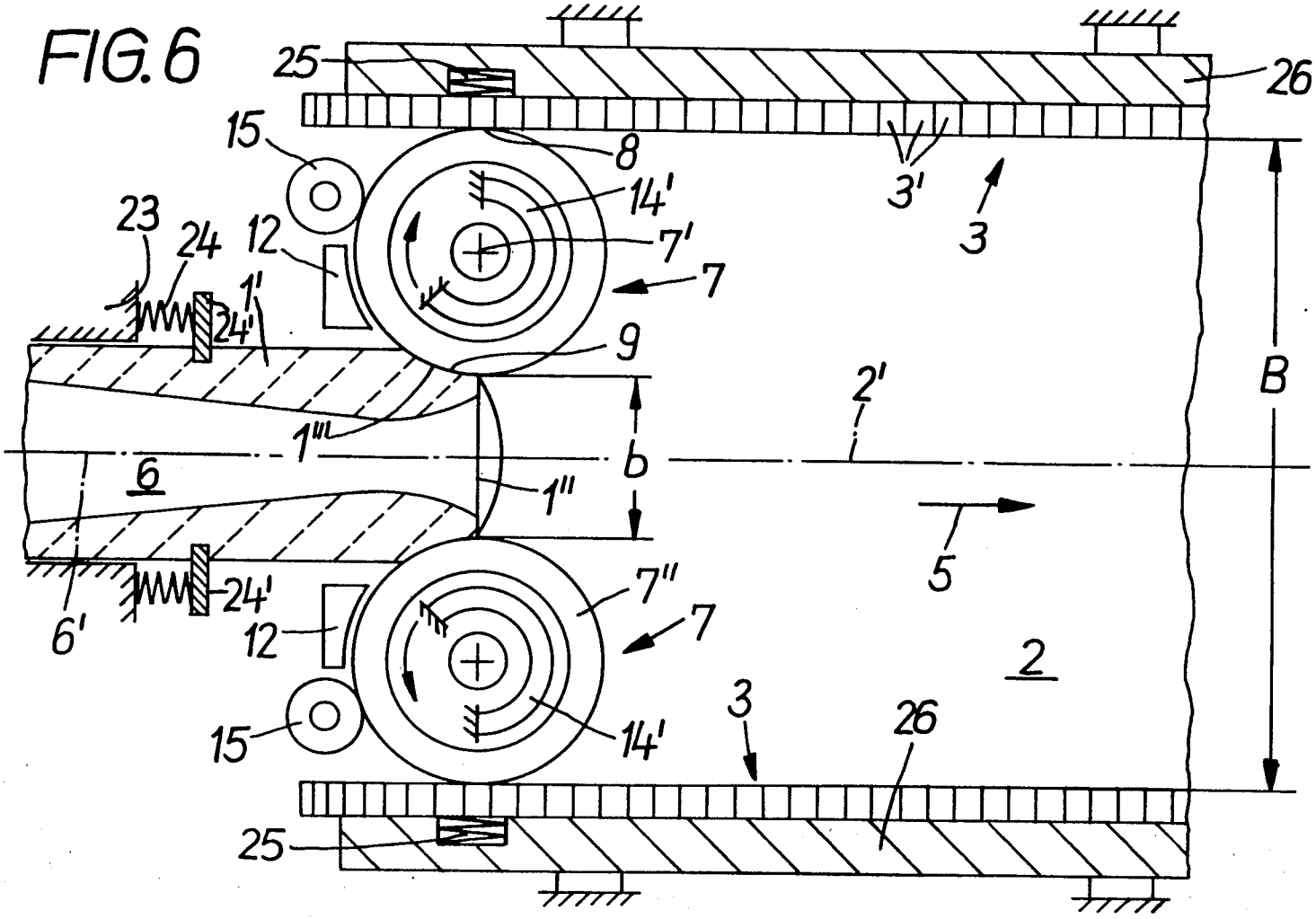
FIG. 6 is a horizontal partially sectional view of an apparatus according to the present invention illustrating a modification of the apparatus of FIG. 5 in that heating units are provided which, in the region of the casting nozzle mouthpiece, are simultaneously effective as an electromagnetic barrier against the escape of steel melt.

In the embodiment according to FIG. 6, the heating units 14', which are held stationarily within ceramic wheels 7 and are designed as inductors, are lengthened to such an extent that they extend, in the direction of rotation, along the region of the curved outer surfaces 1''' of the mouthpiece 1', i.e. along the seals 9, and, in the direction opposite to the direction of rotation, as already described, into the region of the seals 8 formed with the lateral dams 3. The heating units 14' of this configuration, which enclose an angle of more than 180°, serve not only to preheat the ceramic wheels 7, but moreover, in cooperation with one another, they simultaneously also generate electromagnetic forces to prevent or make more difficult the entrance of steel melt into the region of seal 9 between members 1' and 7.

Figure 7:
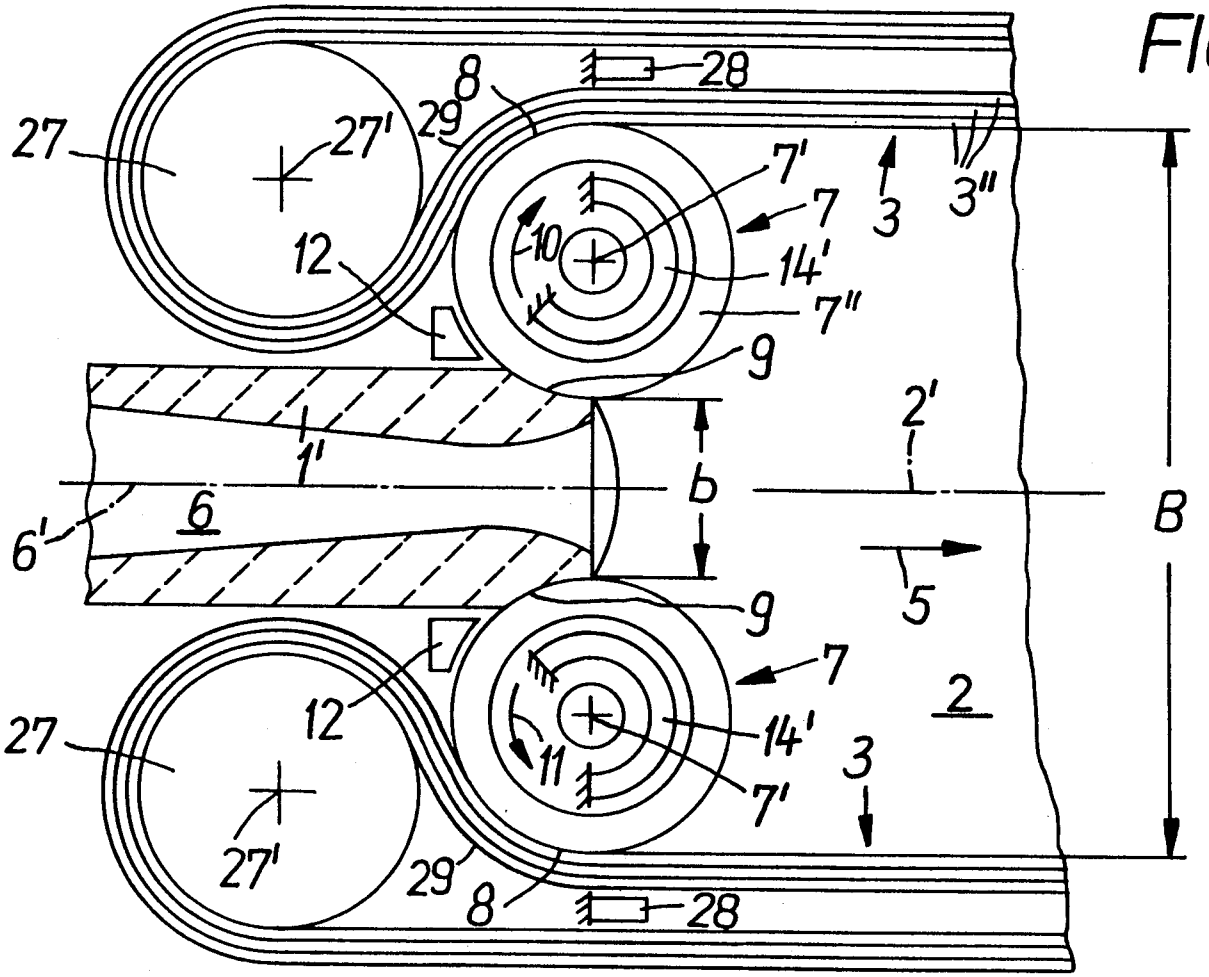
FIG. 7 is a horizontal, partially sectional view of the apparatus according to the present invention in which the lateral dams are comprised of multi-layer steel belts which are curved in the horizontal plane and which are equipped with additional inductors facing the exterior of the steel belts and cooperating with the inductors of the ceramic wheels.

Instead of the lateral dams 3 described above which are composed of individual members 3' forming an endless chain without the ability to negotiate curves in the horizontal plane, lateral dams can also be used, as shown in FIG. 7, which are composed of a plurality of layers of juxtaposed, endless steel belts 3'' and which, consequently, are able to negotiate curves in the horizontal plane.

The multi-layer steel belts 3'' are guided in their respective regions by means of driven guide rollers 27 which are disposed upstream of the ceramic wheels 7 when seen in the casting direction (arrows 5) in such a manner that respective loop sections 29 are formed which engage an elongated portion of the peripheral surface of the respective wheels 7 and which form respective seals 8 with the ceramic wheels 7. These loop sections 29 are advisably designed such that the ceramic wheels 7 are moved along by the belts 3'', without being individually driven, in the direction of arrows 10 and 11, respectively. Thus, in this case, the additional devices required to operate the ceramic wheels 7 are comprised only of a coating unit 12 and a heating unit 14'.

The bearings for guide rollers 27 should be designed, so that the position of rotation axes 27' can be set with respect to that of wheel axes 7' in order to adapt the position of the axes 27' to length tolerances of the belts.

Since, in the case of the embodiment of FIG. 7, the lateral dams are made of steel, the seal 8 between the ceramic wheels 7 and the multi-layer steel belts 3'', as well as the seal 9, can be blocked against the escape of steel melt to the outside by means of electromagnetic forces. For this purpose, additional stationary inductors 28 are arranged on the exterior of the multi-layer steel belts at the position of the connecting line between the wheel axes 7', and each of these additional inductors 28 cooperates with the heating unit 14' of the respectively adjacent ceramic wheel 7. Thus, one additional inductor 28 and one heating unit 14 together form an electromagnetic barrier which counteracts the escape of steel melt.

The steel belts 3'' of the embodiment of FIG. 7 have a thickness in the order of magnitude around 1 mm; the individual members 3' of the exemplary lateral dams 3 shown in FIG. 1 are cast pieces which are manufactured of a brass alloy.

In order to obtain a cast sheet which has a cross section of 1200×50 mm with the apparatus according to the invention, a mouthpiece 1' having an exit cross section 1'' of 200×50 mm as described above may be utilized. In such case, the associated ceramic wheels 7 have a radius of 250 mm and a height of 50 mm.

To be able to realize the largest possible transition region between the exit width b of mouthpiece 1' and the mutual distance B between lateral dams 3, the ceramic wheels 7 should be arranged with respect to the mouthpiece 1' so that their wheel axes 7' lie at least in the vicinity of exit cross section 1''.

As heating unit 14 (cf for example FIG. 1 and FIG. 5) suitably arranged gas burners can conveniently be used, located outside, inside, or outside and inside the ceramic wheels 7.

Figure 8:
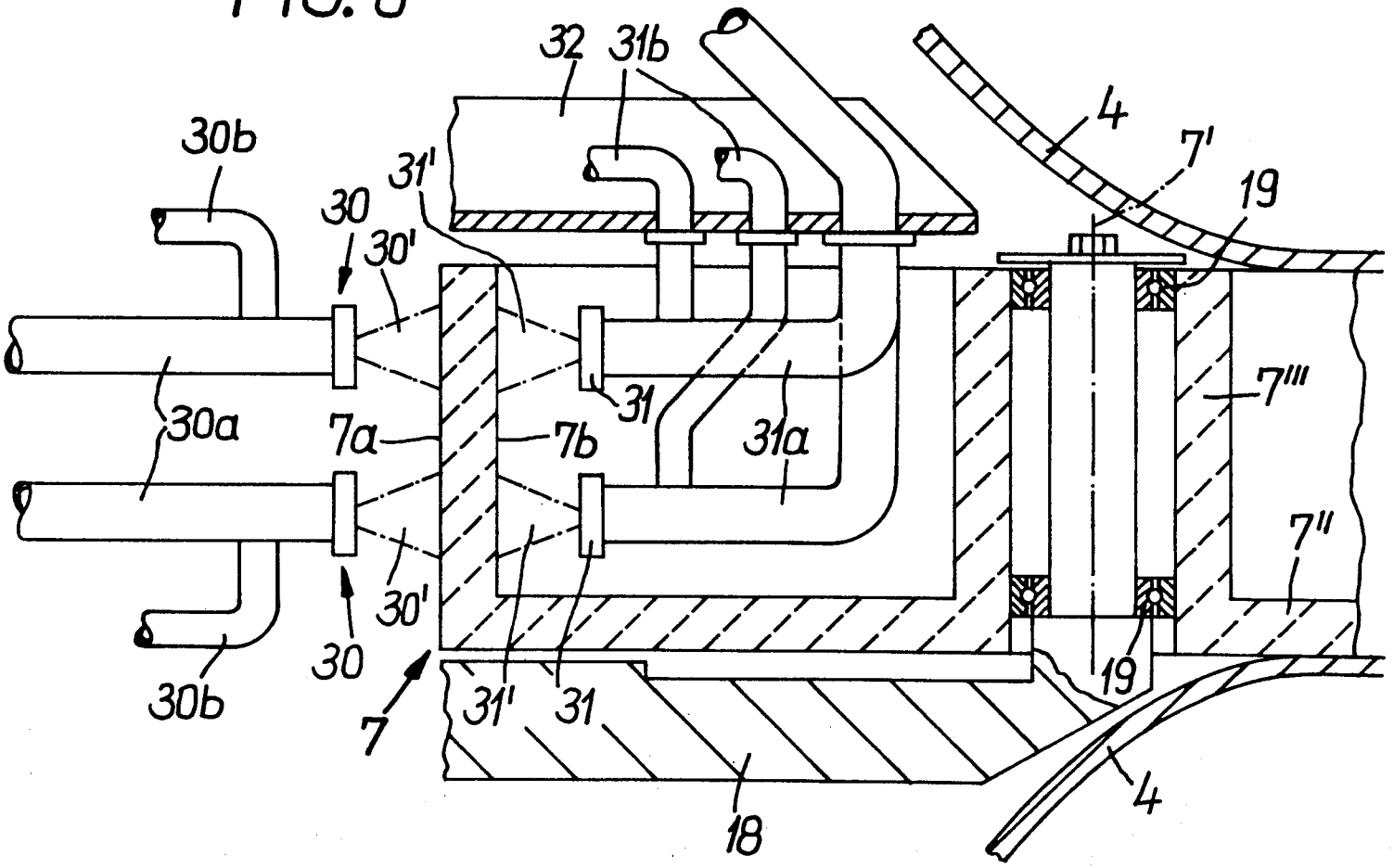
FIG. 8 shows a vertical section through an apparatus according to the invention in the region of a ceramic wheel opposite whose outer and inner peripheral surfaces are arranged stationary gas burners.

In the embodiment according to FIG. 8, opposite the outer and inner peripheral sufaces 7*a* and 7*b* of each ceramic wheel 7, two gas burners 30 and 31 are arranged one above the other, whose flames 30′ and 31′ lick the relevant peripheral surface and heat it to the required temperature.

Each of the two gas burners has an air supply pipe designated 30*a* and 31*a*, respectively, into the front part of which branches a small-diameter gas supply pipe 30*b* and 31*b*.

The two gas burners 31—which like the gas burners 30 are held stationary—project into the space between the wheel hub 7‴ and the wheel rim 7″ in such a way that the ceramic wheel 7 can freely turn as required; they are fastened via the air supply pipes 31*a* and the gas supply pipes 31*b* to a support arm 32 which is arranged at a distance above the ceramic wheel 7 in front of the upper casting belt 4.

It will be understood that the above description of the present invention is susceptible to various modifications, changes and adaptations, and the same are intended to be comprehended within the meaning and range of equivalents of the appended claims.

What is claimed is:

1. In an apparatus for the continuous casting of steel sheet, particularly to sheet cross sections of a small thickness down to a lower limit of about 30 mm and a width of about 500 to 1500 mm, comprising a continuous caster having comoving mold walls which define a casting cavity and including a pair of oppositely disposed endless casting belts which form the upper and lower walls of said casting cavity and a pair of oppositely disposed endless lateral dams which form the lateral walls of said casting cavity, and a tubular casting nozzle having a mouthpiece which extends symmetrically into said casting cavity and contacts said casting belts forming said upper and lower casting cavity walls to form a seal therebetween; the improvement wherein: the width of said mouthpiece of said casting nozzle at its exit cross section is less than approximately 50% of the width of said casting cavity; and said apparatus further comprises: means for sealing the space in said casting cavity between each of said lateral dams and the adjacent side wall of said mouthpiece of said nozzle, said sealing means including a pair of wheels each having a ceramic outer rim portion, means for mounting each of said wheels for rotation about a respective vertical axis such that said wheels are symmetrically disposed between said mouthpiece and said dams, and each of said wheels has a diameter such that its said rim portion contacts one of said lateral dams and the said adjacent side wall of said mouthpiece and a height such that is upper and lower surfaces contact said upper and lower walls respectively of said casting cavity formed by said endless belts; and means for rotating said wheels.

2. Apparatus as defined in claim 1 wherein said axes of rotation of said wheels are disposed in the vicinity of the exit opening of said mouthpiece of said nozzle.

3. Apparatus as defined in claim 1 wherein said axes of rotation of said wheels are disposed in a vertical plane which includes said exit opening of said mouthpiece.

4. Apparatus as defined in claim 1 wherein said width of said mouthpiece at its said exit cross section is less than 20% of the width of said casting cavity.

5. Apparatus as defined in claim 1, wherein said means for rotating said wheels causes said wheels to rotate in a direction such that the portion of each said wheel facing said mouthpiece rotates in a direction opposite to the casting direction.

6. Apparatus as defined in claim 5 further comprising a respective coating means, disposed adjacent the portion of each wheel facing away from said casting cavity, for covering at least the circumferential ceramic surfaces of each of said rotating wheels with a coating agent which prevents sticking of the steel melt to the ceramic surface of said wheel.

7. Apparatus as defined in claim 5 further comprising heating means for preheating at least the ceramic circumferential surface of each of said wheels to a temperature between 900° and 1300° C.

8. Apparatus as defined to claim 7, wherein one of said heating means is disposed opposite the outer portion of each of said wheels facing away from said casting cavity.

9. Apparatus as defined in claim 7, wherein: said wheels include a hub connected to said ceramic rim via a laterally extending portion; and each said heating means is stationary and disposed in the space between said rim and said hub of a respective said wheel.

10. Apparatus as defined in claim 9, wherein said heating means are disposed in said spaces so that they extend adjacent at least the inner surface of the portion of said rims which face said casting cavity.

11. Apparatus as defined in claim 9, wherein said heating means are provided in the form of inductors and are designed and disposed for simultaneously providing electromagnetic barriers for preventing the escape of steel melt in the direction opposite the casting direction past said ceramic rims of said wheels.

12. Apparatus as defined in claim 11 wherein said inductors of said heating means extends along at least the half of the inner surface of said rim which faces said casting cavity.

13. Apparatus as defined in claim 5 wherein said drive means for each of said wheels is disposed adjacent the outer portion of each said wheel which faces away from said casting cavity.

14. Apparatus as defined in claim 13, wherein each of said drive means includes a drive roller driven by a compressed air motor and means for urging said drive roller into resilient contact with the peripheral ceramic surface of said wheel.

15. Apparatus as defined in claim 14 wherein each of said sidewalls of said mouthpiece is provided with a concavely curved portion adjacent said exit cross-section so that the width of said mouthpiece becomes narrower in a direction toward said exit cross-section, with said curved portions matingly contacting a portion of said rims of said wheels.

16. Apparatus as defined in claim 15 further comprising: means for mounting said mouthpiece so that it is movable in the casting direction; and means for resiliently urging said curved portions of said sidewalls of said mouthpiece into contact with said rims of said wheels.

17. Apparatus as defined in claim 5 further comprising means for mounting said mouthpiece so that it is movable in the casting direction; and means for resiliently supporting said mouthpiece on the ceramic wheels in the vicinity of its said exit cross section.

18. Apparatus as defined in claim 5 further comprising pressure means for resiliently urging said lateral dams into contact with said ceramic rims of said wheels.

19. Apparatus as defined in claim 7 wherein each of said lateral dams is comprised of endless multi-layer steel belts which are held in contact with a portion of said ceramic rim of the associated said wheel by means of a guide roller disposed upstream of the associated said wheel when seen in the casting direction, whereby said lateral dams simultaneously serve as said means for rotating said wheels.

20. Apparatus as defined in claim 19 wherein: said wheels include a hub connected to said rim via a laterally extending portion; each said heating means is stationary and disposed in the space between said rim and said hub of a respective said wheel, and extends at least between the regions of contact of the respective said wheel and said mouthpiece and the associated said lateral dam and adjacent the inner surface of the portion of the respective said rim which faces said casting cavity; each said heating unit is an inductor which is disposed in the respective said space so as to provide an electromagnetic field and a respective additional inductor is disposed on the outside of each of said multi-layer steel belts opposite the respective said heating unit to provide an additional electromagnetic field which, together with said electromagnetic field from said heating unit, forms an electromagnetic barrier to prevent the escape of steel melt in the direction opposite the casting direction between said rims of said wheels and said multi-layer steel belts.

* * * * *